US007588043B1

(12) United States Patent
Bais

(10) Patent No.: US 7,588,043 B1
(45) Date of Patent: Sep. 15, 2009

(54) APPARATUS FOR MOBILIZATION OF INDIVIDUALS RESULTING FROM INJURY OR SURGERY TO FOOT

(76) Inventor: Mario G. Bais, P.O. Box 281162, San Francisco, CA (US) 94128

( * ) Notice: Subject to any disclaimer, the term of this patent is extended or adjusted under 35 U.S.C. 154(b) by 0 days.

(21) Appl. No.: 11/956,084

(22) Filed: Dec. 13, 2007

(51) Int. Cl.
*A63H 3/00* (2006.01)

(52) U.S. Cl. ..... 135/67; 135/66; 135/74; 482/68

(58) Field of Classification Search ..... 135/65–67, 135/85, 74; 482/66–69; 280/87.02, 87.021, 280/87.041; 297/5–9
See application file for complete search history.

(56) References Cited

U.S. PATENT DOCUMENTS 1,361,102 A * 12/1920 Scott ..... 482/67
2,798,533 A * 7/1957 Frank ..... 297/6
2,817,387 A * 12/1957 Blake ..... 135/67
4,532,948 A * 8/1985 Burrows ..... 135/67
4,621,804 A * 11/1986 Mueller ..... 280/87.041
4,974,620 A * 12/1990 Quillan et al. ..... 135/67
5,058,912 A * 10/1991 Harroun ..... 280/87.021
5,271,422 A * 12/1993 Sorrell et al. ..... 135/66
5,443,304 A * 8/1995 Fochs ..... 297/467
5,657,783 A * 8/1997 Sisko et al. ..... 135/67
5,704,682 A * 1/1998 Gorayeb et al. ..... 297/5
5,819,772 A * 10/1998 Pi ..... 135/66
5,882,067 A * 3/1999 Carbajal et al. ..... 297/6
6,467,797 B1 * 10/2002 Lofy et al. ..... 280/647

* cited by examiner

*Primary Examiner*—Winnie Yip

(57) ABSTRACT

A walker that avoids any pressure on the injured foot while allowing the person to walk on its own, which is accomplished by providing a limb support at knee height, made of a strong canvas material, coupled with the stability of a four legged frame made of a light weight material, together encompassing this mobilization devise which provides the foot injured or operated person an instrument to move about without having to lean the injured foot on the floor, being easy to maneuver, and additionally provided with convenient height adjustment and easy folding/unfolding capabilities.

1 Claim, 6 Drawing Sheets

APPARATUS FOR MOBILIZATION OF INDIVIDUALS RESULTING FROM INJURY OR SURGERY TO FOOT

TECHNICAL FIELD OF THE INVENTION

The present invention refers to a device to simplify and help people who have a foot operation or have a sprain or injure to walk and move around.

PROBLEM TO SOLVE

For the people who've been injured or operated on the foot, the classical crutches are known for mobilization, such element not being practical or easily handled by patients, presenting difficulties to be used especially taking in consideration if the patient is of an older age. This apparatus solves the problem due to its stability, inclusive during mobilization, especially on people that should not lean their injured foot during long periods of time, helping to rest the remaining of the body.

OBJECT OF INVENTION

This invention is a foldable walker with a fabric support to assist a person with a foot or leg injury, pursuing the finality to favor people with medical prohibition of leaning the injured foot, either being on a cast or not.

Leaning the knee on this apparatus and accompanying the movement of the step, making the body rest on it, enables the patient to move around the house with ease, to do the usual chores as cooking, washing, ironing, laundry and keeping up with the daily hygiene, etc., as also makes one able to keep up with the traveling for the doctors or recuperation appointments, as it is foldable and easily fits on any vehicle.

BRIEF DESCRIPTION OF THE DRAWING

In order for the object of the invention to be more comprehensible, it has been illustrated with six drawings as demonstrative examples.

DETAILED DESCRIPTION OF THE INVENTION

On the drawings, the reference numbers are indicating the different elements and their application.

Figure 1:
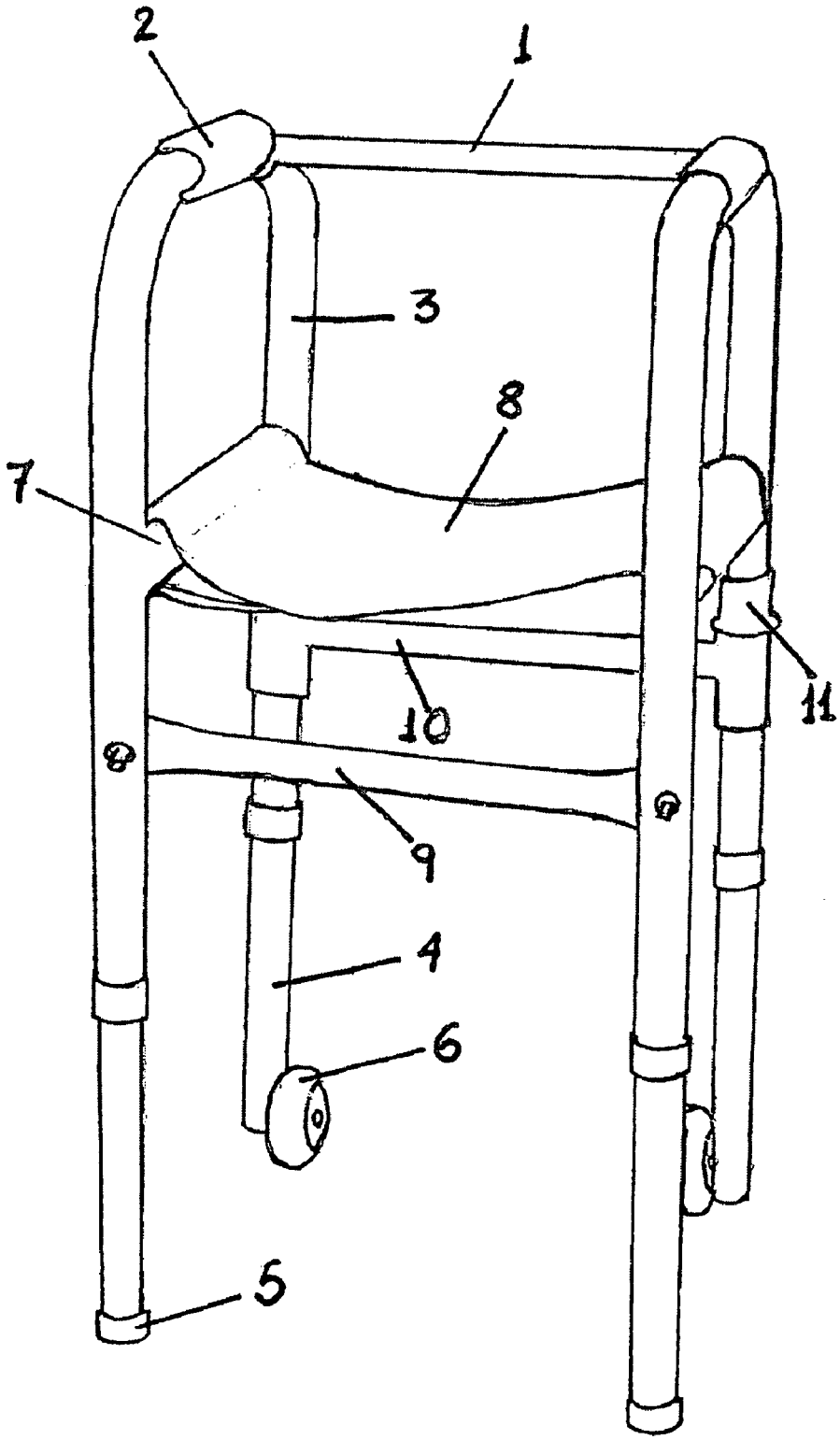
FIG. 1: is a view of the front of the apparatus fully open.
Figure 2:
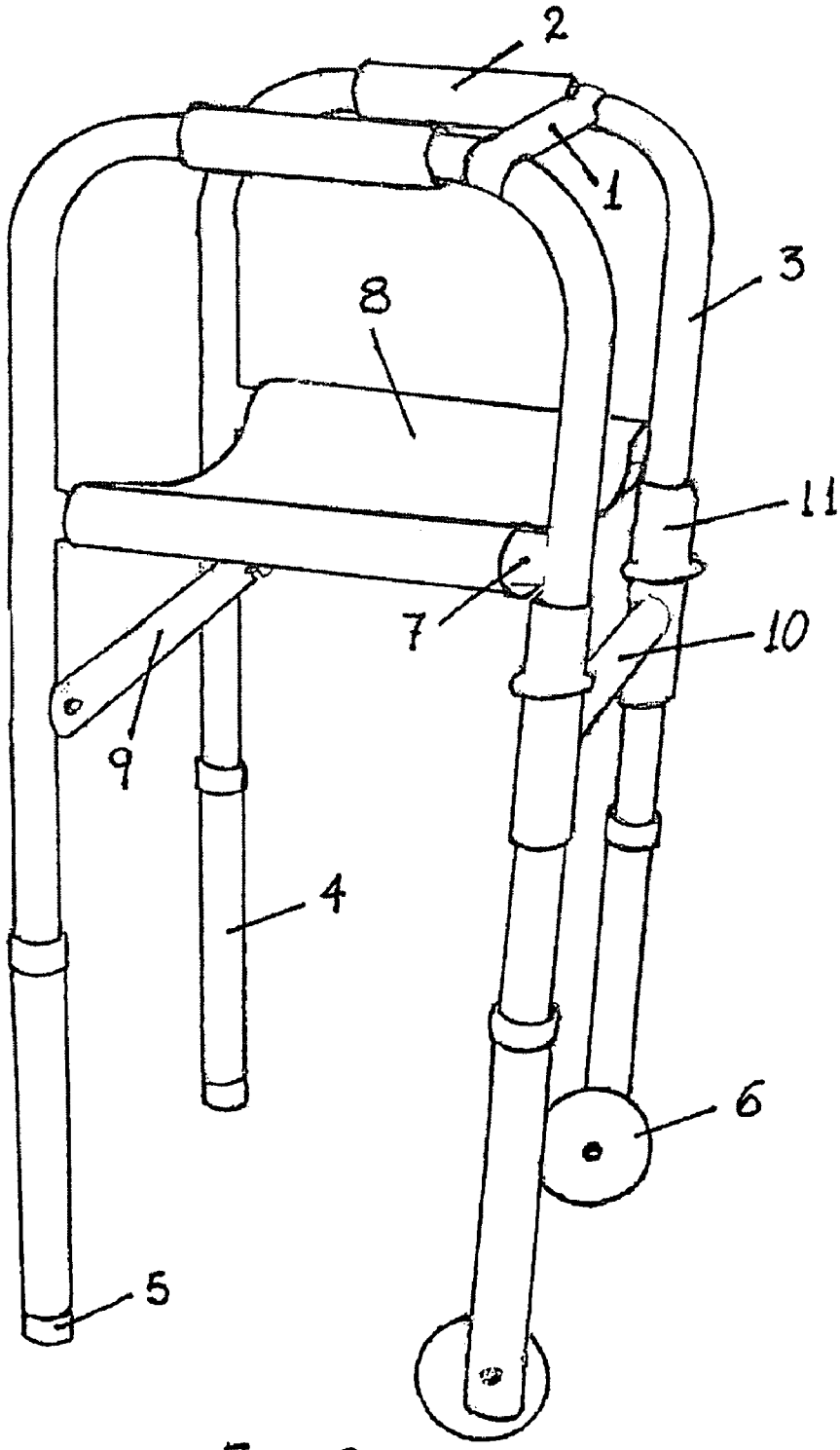
FIG. 2: is a view of the same, on the left side.
Figure 3:
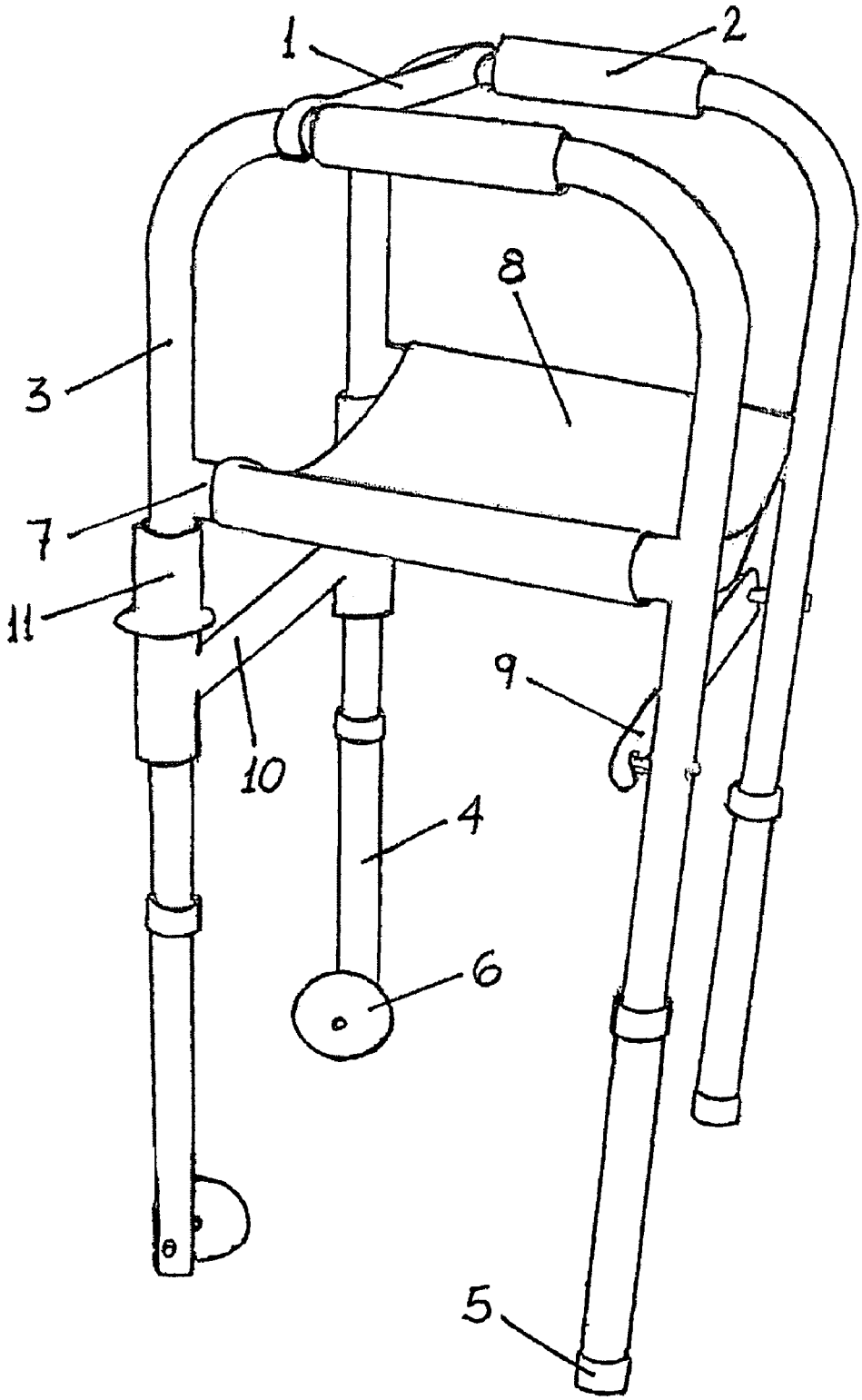
FIG. 3: is a view of the same, on the right side.
Figure 4:
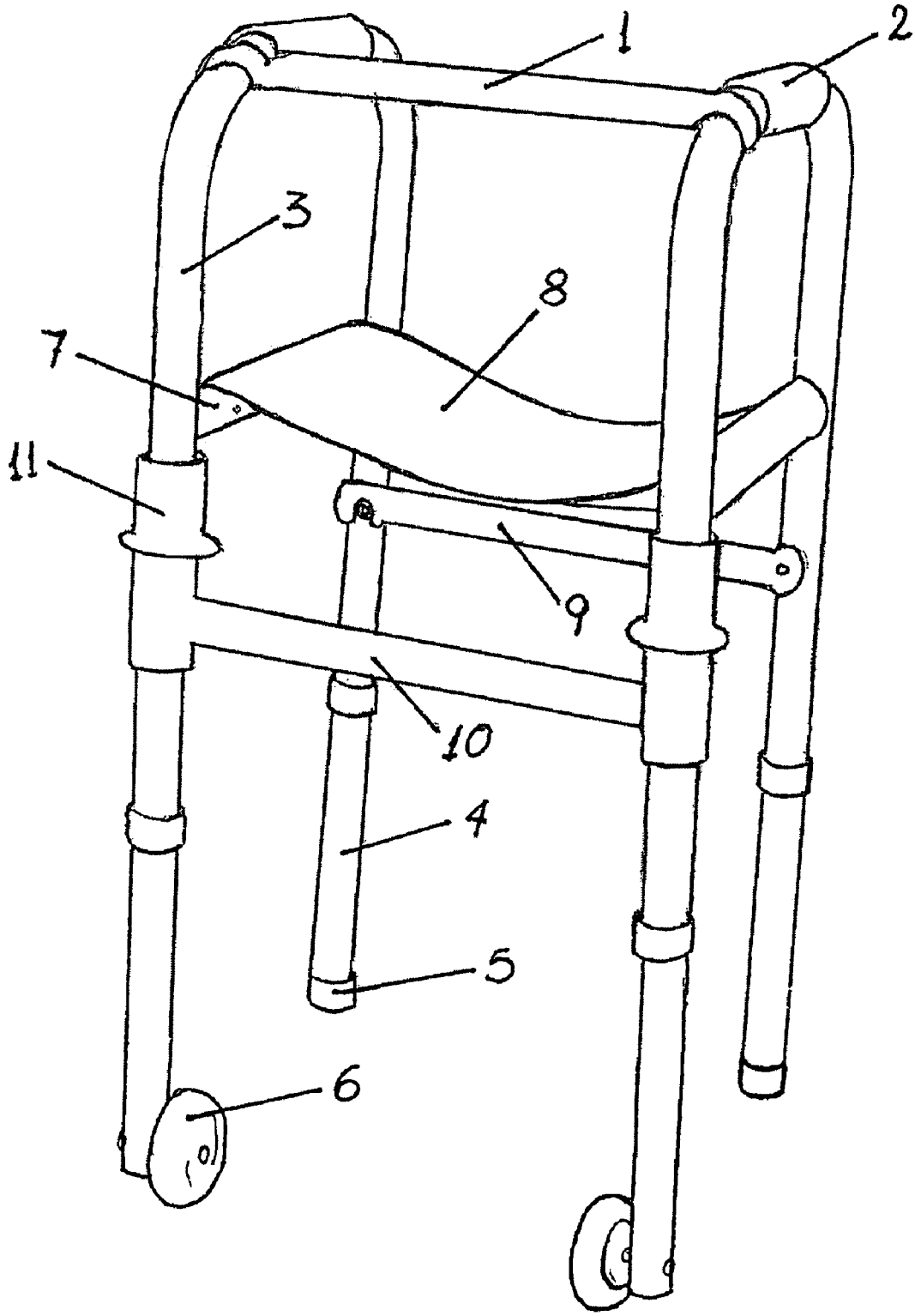
FIG. 4: is a view of the back.
Figure 5:
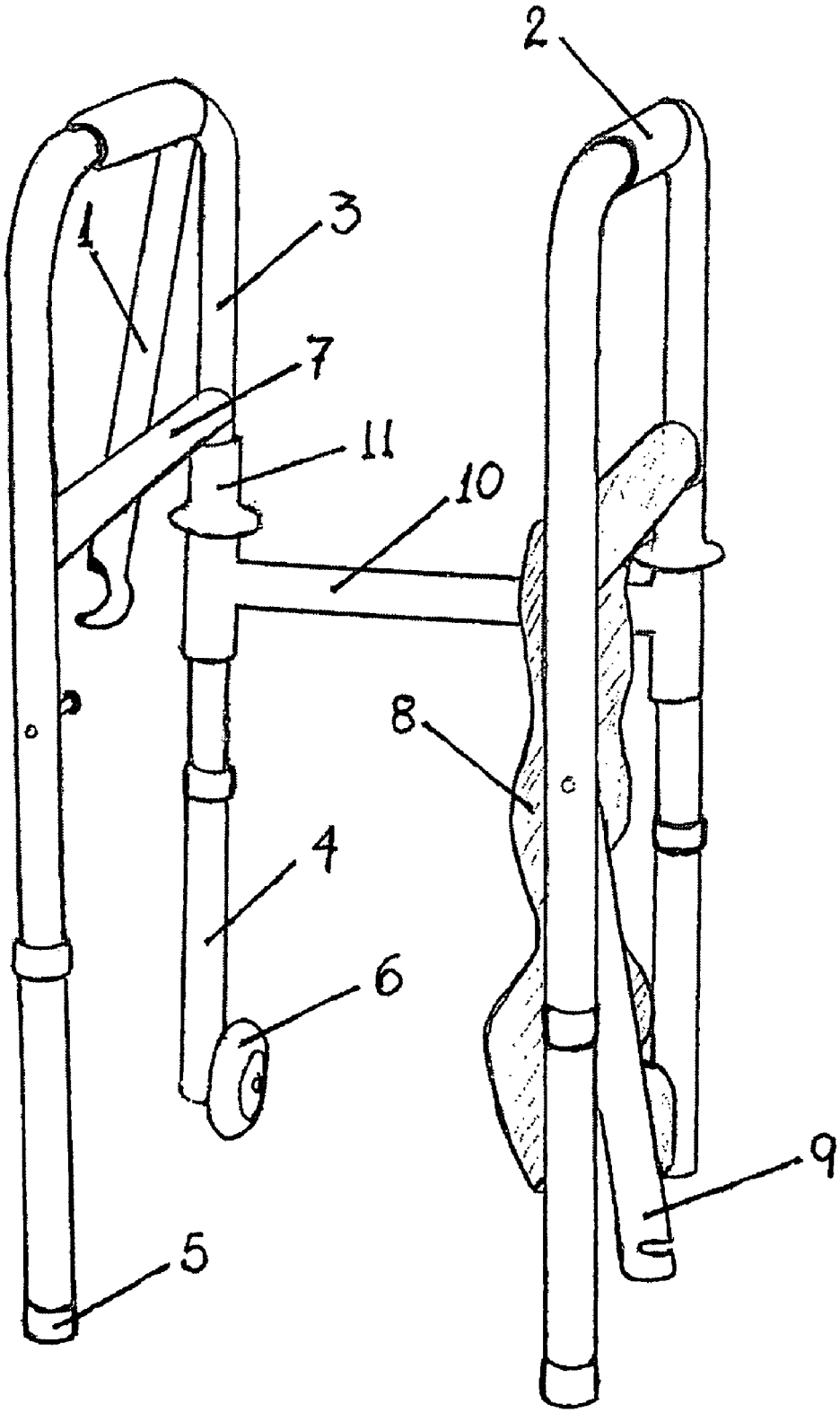
FIG. 5: is a view of the front, ready to be folded.
Figure 6:
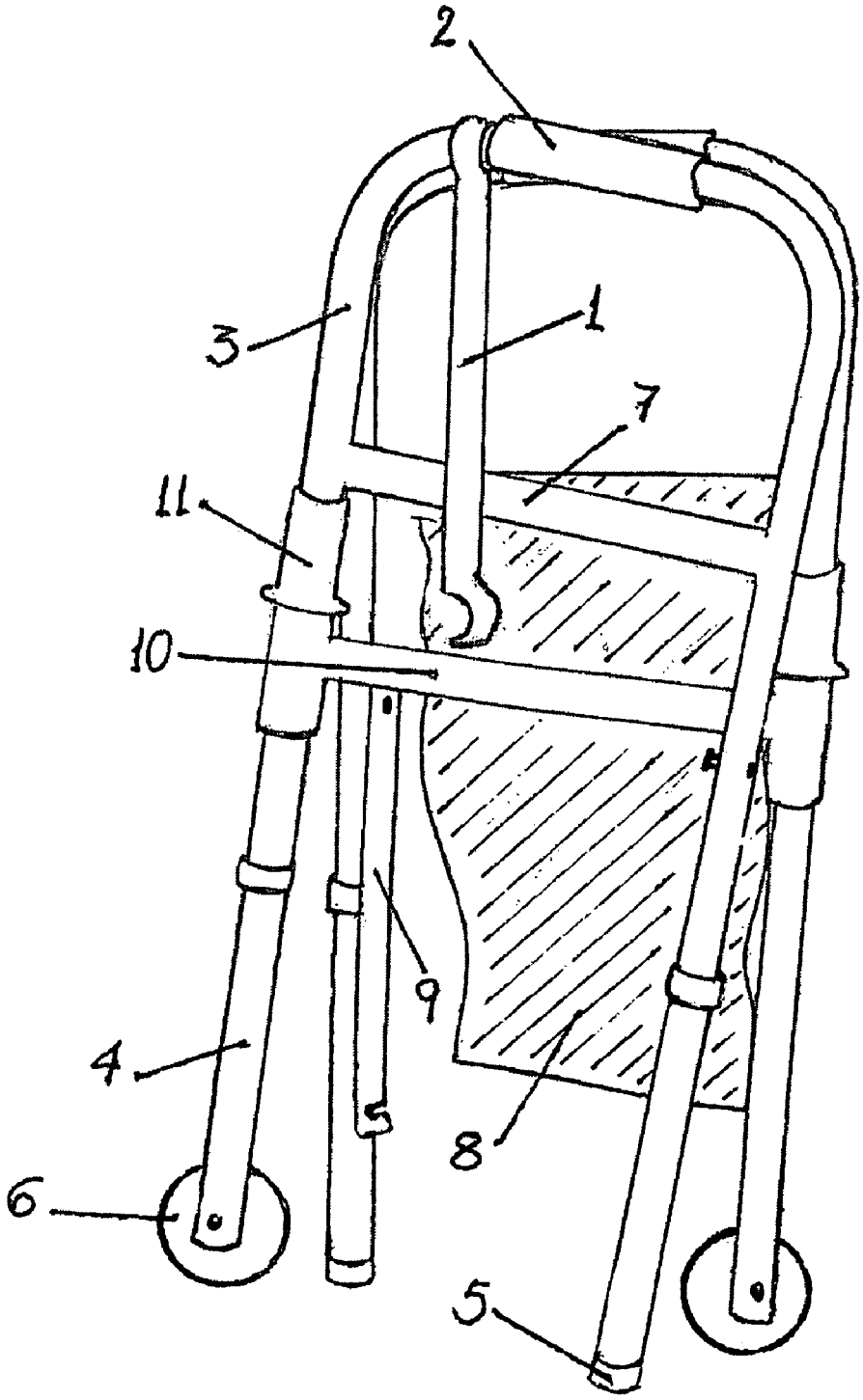
FIG. 6: is a view of the apparatus fully folded.

As seen in FIG. 1 this invention is a foldable walker with a fabric support.

On FIG. 1, front view, on the superior part there is a cross over member (1) for better stability of the complete unit. This member is made on aluminum conduit as the rest of the unit frame. The same mentioned member is attached on the left side with a swivel, and it rests on the right side on a plate. It can be detached from the left side easily and rolled over the left side when folding the unit.

Also on the superior part of the apparatus we find two rubber grips (2) for better handling.

The main frame is composed of two U shape structures (3) of aluminum conduit facing down, separated, attached together by a cross over member (10) with locked swivels (11) at both ends of the cross member. The swivels are made on metal and plastic material, with a push down handle for unlocking, in order to fold the unit.

The ends of the legs (4) are extendible for comfortable height adjustability of the patient stature, just by pushing a button that fits on different holes of the telescopic outer leg.

The front legs end on plastic cups (5), while the rear legs end on small wheels (6) for easier mobility.

Both sides have cross members (7) on the center of the U, made out of plastic or aluminum, with the purpose of holding the fabric (8) where the leg of the patient is intended to rest. This fabric is firmly attached to one side, and rolled over the other side attaching it self with Velcro to it's under belly.

This cross over members (7) can be welded to the main frame U, or they can slide up and down the U conduits with a locking devise for fine adjustment of height.

On the front of the unit there is a cross member (9) bolted to the right leg, and attached to the left leg with a hook type shape at the end, fitting on another bolt attached to the leg. The purpose of this member is stability of the unit under pressure, and it can be easily detached when folding.

The invention claimed is:

1. A foldable apparatus for mobilization of foot injured or foot operated people, comprising: a main frame having a folded position and an open position, the main frame including a. two U-shaped frame members each having a front leg and a back leg, an upper side cross member extending between upper ends of the front and back legs, a hang grip disposed on said upper side cross member, and a lower center side cross member mounted between centers of the front and back legs;

b. a cross over member having a first end being pivotally connected to the upper side cross member and near the front leg of one U-shaped frame member and a second end being detachably mounted to the upper side cross member and near the front leg of the other U-shaped frame member;

c. a cross lower member being pivotally fixed to the back legs of the two U-shaped members for maintaining the two U-shaped frame members together;

d. a cross back member having a first end being pivotally attached to the back leg of one U-shaped frame member and a second end being detachably hooked to the black leg of the other one U-shaped frame member;

e. a locking member being mounted to each of the front legs for locking the U-shaped frame members with the cross lower member when the apparatus in an opening position, and unlocking the apparatus by rotation of the U-shaped frame members close with the cross lower member;

f. a fabric support being attached to and extending between the lower center side cross members of the two U-shaped frame members for supporting the injured foot knee and lower limb of a patient and allowing a patient to mobilize anywhere without having to lean the injured foot on the floor when the apparatus is in an open position, and one side of the fabric support being removable from one U-shaped frame member to allow the patient walking between the U-shaped frame members and being foldable when the apparatus in the folded position; and wherein the two ends of each cross over member and the cross back member are able to be mounted to the two U-shaped frame members for maintaining the two U-shaped frame members in an open position, and the cross over member and the cross back member are able to be removed from one U-shaped frame member and rotated over to the other one U-shaped frame member for allowing the U-shaped members being rapid folded together to easily storage and transformation.

* * * * *